United States Patent [19]

Ghosh et al.

[11] Patent Number: 4,722,754

[45] Date of Patent: Feb. 2, 1988

[54] SUPERPLASTICALLY FORMABLE ALUMINUM ALLOY AND COMPOSITE MATERIAL

[75] Inventors: Amit K. Ghosh, Thousand Oaks; Murray W. Mahoney, Camarillo, both of Calif.

[73] Assignee: Rockwell International Corporation, El Segundo, Calif.

[21] Appl. No.: 905,394

[22] Filed: Sep. 10, 1986

[51] Int. Cl.[4] ..... C22F 1/053; C22C 21/10

[52] U.S. Cl. ..... 148/11.5 A; 148/11.5 P; 148/12.7 A; 148/417; 420/902; 419/41; 419/44

[58] Field of Search ..... 420/902; 148/11.5 A, 148/11.5 P, 12.7 A, 417, 439; 419/41, 44

[56] References Cited

U.S. PATENT DOCUMENTS

| | | | |
|---|---|---|---|
| 3,544,392 | 12/1970 | Lyle et al. | 148/12.7 A |
| 3,775,101 | 11/1973 | Freche et al. | 419/41 |
| 4,486,244 | 12/1984 | Ward et al. | 420/902 |
| 4,537,167 | 8/1985 | Eudier et al. | 148/11.5 P |

*Primary Examiner*—L. Dewayne Rutledge
*Assistant Examiner*—George Wyszomierski
*Attorney, Agent, or Firm*—H. Fredrick Hamann; Craig O. Malin; Gregory O. Garmong

[57] ABSTRACT

Superplastically formable aluminum alloys and composite materials are prepared from rapidly solidified, coarse aluminum powder of a precipitation hardenable alloy, processed to have a low oxide and contaminant content. The powder is mixed, together with reinforcement in the case of the composite material, and then consolidated and extruded at a high extrusion ratio to promote microstructural uniformity and to break up the surface oxide present on the particles. The extrusion is then thermomechanically processed to impart a recrystallized fine-grain aluminum microstructure which is suitable for use in superplastic forming. The unreinforced powder alloy exhibits uniform elongations of over 800 percent at a strain rate of $2\times10^{-4}$ per second, and a composite having 0.10 volume fraction silicon carbide reinforcement exhibits uniform elongations of over 450 percent at the same strain rate.

12 Claims, 2 Drawing Figures

GRAIN SIZE: 6.3 μm

SUPERPLASTICALLY FORMABLE ALUMINUM ALLOY AND COMPOSITE MATERIAL

The United States Government has rights in this invention pursuant to contract No. F33615-83-C-3235, awarded by the Dept. of the Air Force.

BACKGROUND OF THE INVENTION

This invention relates to aluminum based materials, and, more particularly, to superplastically formable aluminum alloys and composites made from aluminum powders.

A continuing consideration in the development of materials for aircraft and spacecraft is the need for achieving higher stiffness and strength in materials of reduced weight, which are also microstructurally uniform, formable, joinable, producible, corrosion resistant, etc. Alloys and composites of aluminum have been developed to meet the many requirements for use in aerospace structures, and most aircraft now use these materials for ambient and moderate temperature structural applications. Because added weight in a flight structure results in severe penalties in performance and fuel costs over the life of the aircraft, reductions of only a few pounds in an aircraft, through use of improved materials, can have significant benefits that justify the added costs of the improved materials.

Aluminum alloys made by powder metallurgical techniques meet many of the requirements for aircraft structural use. Aluminum alloys are first processed into fine powders by melt atomization. The powders are consolidated into a solid structural form by pressure applied at elevated temperature. The processing through the powder form results in a refined microstructure having improved mechanical properties, and also provides a high degree of uniformity throughout a part. Consolidation to nearly the final required shape is often possible using powder techniques, so that machining costs and material waste are minimized.

The use of powder metallurgical techniques also permits the preparation of fine particulate composite materials. Composite materials are physical mixtures of two or more components which retain their physical distinctness after fabrication, unlike an alloy wherein the alloying elements are no longer distinct after the alloy is prepared. Composite materials allow the high stiffness and strength of certain finely divided reinforcements to be economically utilized by incorporating these reinforcements into a matrix which surrounds and protects the reinforcements, and contributes its own desirable properties. The composite material exhibits mechanical properties that are a mixture of those of the components, and careful selection of the matrix alloy and reinforcement results in improved composite properties with reduced structural weight.

Many aluminum alloys are commercially available in a powder form. Composite materials having an aluminum matrix and an incorporated reinforcement, prepared by powder metallurgical or casting techniques, are also available. More specifically, aluminum matrix composites with fine silicon carbide reinforcements, prepared by powder consolidation techniques, are in a development stage and can be obtained commercially.

While parts of consolidated aluminum powders, and consolidated mixtures of aluminum powders and reinforcement, have many advantages, their ductility is generally low, with uniform elongations for conventional powder alloys of 15 percent or less, and uniform elongations for a composite with 0.10 volume fraction of reinforcement of 6 percent or less. The low ductility results in poor formability in conventional forming operations which prepare shaped parts from the materials. These materials as currently fabricated also cannot be formed by superplastic forming, a manufacturing technique by which metals can be formed by processes somewhat similar to those used for plastics. To be suitable for superplastic forming, a metal must have a uniform elongation at the forming temperature of 300 to 500 percent or greater. If appropriate microstructures in aluminum powder alloys and composites can be developed, superplastically formable sheet stock can be economically prepared at a central mill for later use by aircraft manufacturers in forming aircraft skin structures and the like at their plants.

Accordingly, there exists a need for aluminum alloys and reinforced composites that exhibit high uniform elongations, and particularly superplastic properties. Such materials must have excellent stiffness and strength so that they impart high stiffness-to-weight and strength-to-weight ratios to the aircraft structure, and would desirably be superplastically formable to permit economical fabrication of parts. The materials must also be compatible with existing manufacturing and processing machinery and procedures. The present invention fulfills this need, and further provides related advantages.

SUMMARY OF THE INVENTION

The present invention is embodied in processes for preparing superplastically formable aluminum and aluminum composite materials from aluminum powders, and the resulting materials. The fabricated materials exhibit uniform superplastic elongations of hundreds of percent, and can be formed superplastically by known procedures. The materials of the invention exhibit mechanical properties superior to those of conventional aluminum alloys, with a powder alloy of 0.10 volume fraction silicon carbide reinforcement having 20 percent greater strength and 25 percent greater modulus of elasticity than conventional 7000 series aluminum alloys. Thus, the present materials provide a new class of structural materials having mechanical properties intermediate between conventional aluminum alloys and metal matrix composites having higher levels of reinforcement content in the range of 30 to 50 volume percent, but having the capability of superplastic formability.

In accordance with the invention, a process for preparing a reinforced superplastically formable aluminum composite material comprises the steps of furnishing an aluminum powder of a precipitation-hardenable aluminum alloy having a reduced oxygen and oxide content, the powder including coarse powder particles; mixing with the aluminum powder a finely divided reinforcement in an amount of less than about 0.20 volume fraction of the total mixture; consolidating the mixture of aluminum powder and reinforcement to form a consolidated billet in a manner minimizing the incorporation of oxygen and oxides into the consolidated billet; reducing the thickness of the consolidated billet by an amount sufficiently great to break up the oxide coating on the aluminum powder particles; and thermomechanically processing the reduced billet to yield a microstructure of reinforcement distributed throughout a recrystallized aluminum alloy grain structure having coarse precipitates therein.

Superplasticity in materials is normally associated with a fine grain structure, and it might be expected that consolidation of a powder having a fine powder particle size would yield a superplastic final product. To the contrary, it has now been found that the high surface oxide and contaminant content associated with aluminum powder of small particle size prevents attainment of superplastic formability by causing premature cavity formation and failure. The present invention therefore utilizes a coarse aluminum powder, so that the volume fraction of surface oxide and contamination on each particle is small. As a result, the contribution of surface oxide and contaminant content to the final product produced from coarse powders is much less than for a product produced from fine powders.

The starting material also has a reduced internal oxygen and oxide content. Reduction of oxygen and contaminant content is accomplished by using clean powder production techniques and aluminum starting materials of low oxygen and contaminant content. Consolidation and processing of the powder are also designed to minimize the introduction of oxygen, oxide and contaminants into the final product.

The starting material is preferably aluminum powder produced by atomization of a prealloyed melt using a dry gas having low oxygen content. An acceptable alloy is alloy PM-64 produced by Kaiser Aluminum & Chemical Corp. and having a nominal composition in weight percent of about 7 percent zinc, 2.3 percent magnesium, 2 percent copper, 0.1 percent chromium, 0.2 percent cobalt, 0.2 percent zirconium, balance aluminum plus minor impurities. (The alloy material also bears the designation 7064.) This powder starting material has a low internal oxygen, surface oxide and contaminant content.

Powder particles passing a 100 mesh standard powder screen are used. A 100 mesh screen has an opening size of about 149 micrometers. By contrast, in much powder metallurgical work powder particles passing a 325 mesh standard screen are used. A 325 mesh screen has openings of about 32 micrometers, so that the larger size powder particles are not passed. The thickness of the oxide and contaminant layer on a powder particle is essentially independent of the size of the particle. Larger particles therefore have a lower volume fraction of surface oxide and contaminant content than do smaller powder particles, with the result that the final consolidated and treated product has a lower oxide and contaminant content. The reduced oxide and contaminant content has been determined to be critical to obtaining a superplastically formable material, inasmuch as the oxides and contaminants cause cavity formation during deformation, which contributes to premature failure of the material before significant superplastic deformation is possible.

The steps of consolidating, reducing and thermomechanically processing are also performed so as to minimize the presence of oxygen, oxides, and contaminants. After the reinforcement is mixed with the aluminum powder, consolidation is preferably performed by loading the mixture into a canister and then vacuum degassing the contents to remove volatile and gaseous contaminants. The canister is sealed and immediately hot pressed by an amount sufficient to consolidate the mixture to 100 percent density. The consolidated billet is then removed from the canister and reduced in thickness, preferably by extruding at an extrusion ratio of about 12 to 1 or greater, to break up the oxide present at the surfaces of the powder particles. The exposed metal on the particles welds to that of adjacent particles during extrusion. The high extrusion ratio also promotes a uniform distribution of the silicon carbide reinforcement within the aluminum matrix.

The use of a coarse aluminum powder results in a microstructure after extrusion that is coarser than would be obtained using a fine aluminum powder. A fine grain structure capable of being superplastic formed is attained in the coarse powder material by thermoplastically processing the extruded material to a fine grain structure having coarse precipitates that help to stabilize the fine grain structure during superplastic deformation. A suitable thermoplastic processing involves solution treating and quenching the extruded material, overaging the solution treated and quenched material to produce coarse precipitates, reducing its thickness by at least about 80 percent by warm rolling and warm cross rolling to introduce sufficient deformation for later nucleating grains at the coarse precipitates, and then recrystallizing the sheet.

The composite material resulting from this processing exhibits a unique microstructure having reinforcement embedded within, and throughout, an aluminum matrix in a generally uniform distribution. The aluminum matrix is produced from coarse powder, but has a generally fine microstructure of less than about 10 micrometers average grain size that is suitable for superplastic forming. Oxide and contaminant content are sufficiently low that fracture by void formation is postponed to high strains.

In a related aspect of the invention, a process for preparing a superplastically formable aluminum alloy, without reinforcement, comprises the steps of furnishing an aluminum powder of a precipitation-hardenable aluminum alloy having a reduced oxygen and oxide content, the powder mixture including coarse powder particles; consolidating the powder particles to form a consolidated billet in a manner minimizing the incorporation of oxygen and oxide into the consolidated billet; reducing the thickness of the consolidated billet by an amount sufficiently great to break up the oxide coating on the aluminum powder particles; and thermomechanically processing the reduced billet to form a recrystallized aluminum alloy grain structure having coarse precipitates therein.

The same comments made previously also apply to this process, except that in thermomechanically processing the alloy, cross rolling is preferred but not required to develop the necessary microstructure. The resulting material is superplastically formable to over 800 percent uniform strain, which has not been previously achieved with an aluminum powder product.

It will now be appreciated that the present invention presents a significant advance in the art of aluminum alloy and aluminum composite structural materials. Superplastically formable materials are produced from aluminum powder starting materials, so that the final product takes advantage of the uniformity and fine solidified microstructure possible with such powder products. The processed materials also have better mechanical properties than available with conventional aluminum alloys, in a material that can be readily and economically fabricated by superplastic deformation. Other features and advantages of the present invention will be apparent from the following more detailed description of the preferred embodiment, taken in conjunction with the accompanying drawings, which description illustrates, by way of example, the principles of the invention.

DETAILED DESCRIPTION OF THE PREFERRED EMBODIMENT

Aluminum alloy powder was obtained from Kaiser Aluminum & Chemical Corp. as alloy PM-64, having a nominal chemical composition in weight percent of 7.0 percent zinc, 2.3 percent magnesium, 2.0 percent copper, 0.12 percent chromium, 0.20 percent cobalt, 0.23 percent zirconium, balance aluminum with minor impurities. This powder is produced by atomization of a prealloyed melt, using a dry gas with a reduced oxygen content to minimize introduction of oxygen into the powder. An atomizing gas of 95 percent nitrogen, 5 percent oxygen has a sufficiently high thermal conduction to cool the particles during atomization. While the PM-64 aluminum powder is preferred, the present process is not limited to this material. Other precipitation hardenable powders are operable, as long as the precautions described herein to achieve good cleanliness and low oxide and oxygen content are undertaken.

Figure 1:
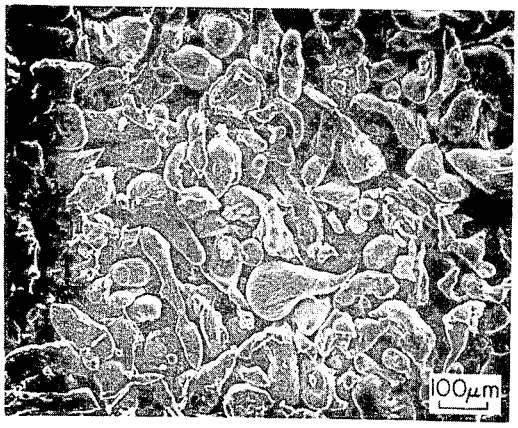
FIG. 1 is a photomicrograph of -100 mesh aluminum alloy powder used as a starting material.

The atomized and solidified powder was sieved in air, and the particles passing a 100 mesh standard powder screen were collected. FIG. 1 illustrates the loose powder before compaction. The powder particles are of a range of shapes and sizes, and many of the particles have a dimension of 100 micrometers or larger. Superplastic deformation usually requires an initial grain size of about 10 micrometers or less, and the subsequent processing imparts this small grain size to the final material.

The use of relatively large powder particles is important to the formability of the final product. Aluminum powder particles quickly form an oxide coating at their surfaces when exposed to air. The surface oxide thickness on an aluminum powder particle is typically about 0.01 micrometers, regardless of the particle size. A large particle therefore has a lesser volume fraction of oxide than does a smaller particle. For example, it has been estimated that the surface oxide content of the powder fraction passing a 325 mesh screen is about 12 volume percent, while the surface oxide content of the powder fraction passing a 100 mesh screen is only about 2 volume percent. The percentages can vary for different particle mixes, but it remains generally true that smaller particles have a higher fraction of surface oxides than do larger particles. The oxide present on the particle surfaces is largely retained through subsequent processing and is present in the final product. The oxides and other surface contaminants are a major cause of the nucleation of cavities that lead to premature failure in superplastic deformation, and reduction of the oxides and contaminants reduce the incidence of premature failure. In the absence of the care taken to reduce the oxide and contaminant content, premature failure is observed.

In preparing an aluminum composite, the aluminum powder is mixed with reinforcement. Mixing can be satisfactorily accomplished in air, without ball milling. The reinforcement is a finely divided material having the desirable properties to be introduced into the aluminum matrix. Specifically, to improve the ratios of stiffness to weight and strength to weight, the reinforcement should have high stiffness, high strength, and low density. Silicon carbide is the preferred reinforcement. Silicon carbide is available in a range of types, sizes, and shapes. In the preferred embodiment, high grade beta silicon carbide was obtained from Carborundum Company. The reinforcement passes a 1000 mesh standard powder sieve, so that the average particle size is about 5 micrometers. The reinforcement is therefore, on the average, much smaller than the powder particles, and can be uniformly intermixed with the powder particles.

The amounts of aluminum powder and silicon carbide to be mixed together are chosen to achieve particular desired volume fractions of aluminum matrix and reinforcement in the final product. The reinforcement volume fraction can range up to about 0.20 (on a volume fraction scale where 1.0 is equivalent to 100 percent). The volume fraction of reinforcement is preferably greater than about 0.05, since for lower volume fractions the modification in properties is insignificant and does not justify the cost of the reinforcement. For a volume fraction greater than about 0.20, the elongations achieved with the final product are reduced below the levels needed for superplastic deformation. Nonuniform thinning, which reduces the superplastic elongation, is observed. As an example of the amounts required, a mixture of about 55 pounds of PM-64 aluminum alloy powder and 5.5 pounds of silicon carbide reinforcement results in a final aluminum composite material having a volume fraction of silicon carbide particles of about 0.10.

After mixing, appropriate amounts of the mixture are cold isostatically pressed to a density of about 70 percent of full density using a pressing pressure of about 30,000 pounds per square inch. This pressed compact can be handled conveniently and used in further processing.

The pressed compact is consolidated to substantially full density by hot consolidated. Care is taken to minimize the introduction of oxygen, oxides, and contaminants into the consolidated billet. Since the pressed compact has approximately 30 percent porosity, oxygen and contaminants would be trapped in the fully consolidated billet if care were not taken to exclude them.

In the preferred approach to consolidation, the pressed compact is loaded into an aluminum alloy canister and placed into an electric furnace operating at 400° C. A vacuum of about 5 millitorr is applied to the interior of the canister, which is otherwise sealed, through a vent tube. The canister is back-flushed several times with pure nitrogen. After about 6 to 7 hours of evacuation, the great majority of free gases and volatile contaminants have been removed from the compact and the interior of the cansiter. The vent tube is sealed by pressure welding, producing an evacuated sealed container with the compact inside. The canister is then hot consolidated to full density in an extrusion press preheated to 400° C. and at a pressure of 80,000 pounds per square inch, so that the compact is densified to substantially 100 percent density.

This vacuum canning and cleansing technique minimizes the incorporation of oxygen and other gaseous contaminants into the final consolidated billet. The presence of oxygen and contaminants can result in microscopic internal voids or cavities in the billet. The voids and cavities enlarge during deformation and cause the material to fail prematurely when deformed in a superplastic forming test or operation. The special care taken to avoid oxygen and contaminants helps to achieve the superplastic properties of the material. As used herein, terms such as "having reduced oxygen and oxide content", "in a manner minimizing the incorporation of oxygen and oxides", and the like, indicate the use of a metallurgical practice that minimizes the presence of oxygen and oxides in the final material. Various practices can be used to achieve such a material, and are within the scope of the invention.

The canister portion is machined away, and the consolidated billet is extruded at a high extrusion ratio to fracture the oxide layers on the particles and to distribute the reinforcement uniformly throughout the solid body. Even though the average size of the aluminum powder particles is large and care is taken to remove gaseous oxygen and contaminants, an oxide coating remains on the surface of each particle. The oxide prevents metal-to-metal contact between adjacent particles. Heavy working fractures the oxide surface layers and allows adjacent particles to weld together at the metallic surfaces exposed when the oxide fractures. The extrusion ratio is the ratio of the cross sectional area of the body before and after passing through the extruder. The greater the extrusion ratio, the greater is the degree of working and breaking up of the oxide coatings on the particles. The uniformity of the distribution of the reinforcement within the extruded body is also improved. Extrusion ratios of 12 to 1 and 18 to 1 were found to be satisfactory, with 18 to 1 preferred. An extrusion ratio of 4 to 1 produced product having low elongation in superplastic testing, possibly due to the presence of excessive oxide that caused cavity formation. Extrusion ratios significantly below about 12 to 1 therefore do not produce a sufficiently high degree of oxide fracture and reinforcement uniformity. In the preferred embodiment, extrusion was accomplished at a billet temperature of about 454° C.

The extruded billets were then thermomechanically processed to produce a recrystallized aluminum matrix grain structure having coarse precipitates therein, and further having reinforcement embedded therein and distributed generally uniformly throughout the matrix. In the preferred embodiment, the extruded bar was solution heat treated at 482° C. for 1 hour, quenched in ambient temperature water, and then overaged at 400° C. for 8 hours to create a distribution of large precipitates in an aluminum alloy matrix.

The heat treated extrusion was rolled with a sufficient reduction in thickness to create strain centers about the large precipitates, and possibly the reinforcement. These strain centers serve as nucleation sites for the final grain structure produced in the subsequent recrystallization treatment. In practice, a reduction of thickness of about 90 percent was accomplished in a minimum number of steps, at a rolling temperature of 300° C.

Due to the oriented morphology of the reinforcement after extrusion, the reduction in thickness is accomplished by rolling in the extrusion direction to a reduction in thickness of about 50 percent, followed by cross rolling to the final thickness. As an example of an acceptable rolling schedule, a 0.8 inch thick extrusion is rolled parallel to the extrusion direction to a thickness of about 0.4 to 0.45 inches. The reduction is accomplished at 300° C. in 10 roll passes, with the material reheated to temperature between each pass by placing it into an oven operating at this temperature for 10 minutes. The material is then cross rolled at 90° to the extrusion direction to a thickness of 0.080 inches, again in 10 to 12 passes at 300° C. with reheating between each pass. It is sometimes necessary to shear off the edges during the cross rolling to prevent the propagation of edge cracks into the interior of the piece. Other sequences of rolling and cross rolling are operable, such as alternating steps of rolling and cross rolling.

Figure 2:
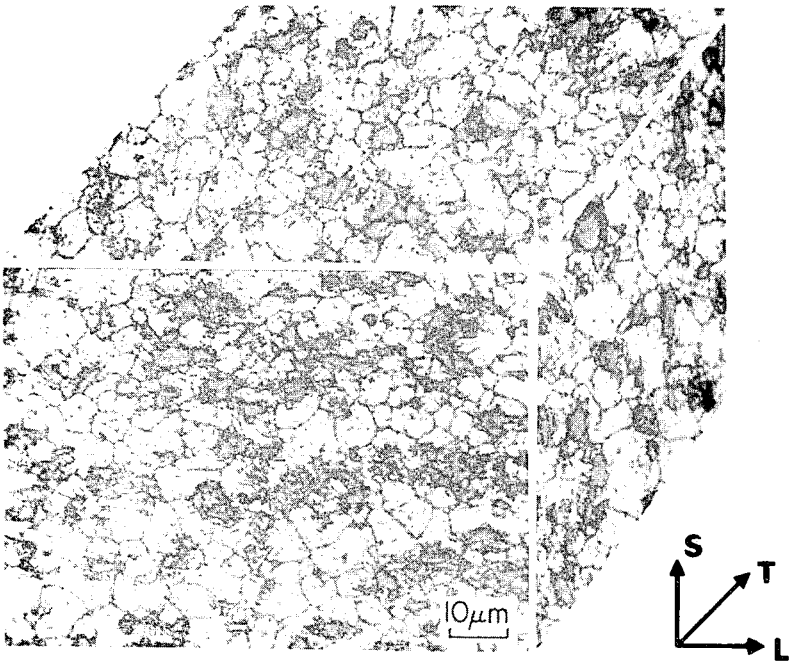
FIG. 2 is a composite photomicrograph of the microstructure of a PM-64/0.10 volume fraction silicon carbide composite material sheet after thermomechanical processing.

The rolled and cross-rolled material is then recrystallized, as by heating to a temperature of 482° C. for ½ to 1 hour. The resulting microstructure is generally equiaxed with silicon carbide reinforcement distributed throughout, as illustrated in FIG. 2. The grain size is on the order to about 6 to 10 micrometers, which is sufficiently small for superplastic deformation. The uniform elongation during elevated temperature deformation is over 450 percent, which is sufficient for superplastic forming. Remarkably, the composite material having up to 0.20 volume fraction of reinforcement, and made from aluminum powder, is superplastically formable to several hundred percent elongation without premature failure by cavity formation or other mechanism.

A superplastically formable aluminum alloy having no reinforcement was made in an identical manner, except for the differences next indicated. The same powder material and powder treatment procedures are used. No reinforcement is mixed with the aluminum powder, however. The aluminum powder is consolidated into a compact by cold pressing and then into a billet by hot consolidation, using the same vacuum evacuation and consolidation procedure previously described. The consolidated billet is extruded with a high extrusion ratio to fracture the oxide coating on the particles. The extruded billet is thermomechanically processed, by solution treating at the same temperatures and times as for the composite material, and then quenching. The thickness is reduced by rolling to a reduction in thickness of about 90 percent at a temperature of 150° C. Cross rolling is not necessary, but is preferred and aids in obtaining the desired microstructure. The resulting material has a grain size of about 6 to 10 micrometers and exhibits superplastic uniform tensile elongations of 700 to 900 percent at a strain rate of $2\times10^{-4}$. The yield strength of 87,000 pounds per square inch is significantly greater than that of prior high strength powder alloys such as PM 7075 or PM 7475, which have yield strengths of about 68,000 pounds per square inch.

In the normal utilization of the powder metallurgy alloys and composites of the invention, the material is fabricated to a sheet form that is subsequently superplastically formed. After forming is complete, the material can be further heat treated to modify its strength and elongation properties, so that the final part has an optimally heat treated microstructure. Alternatively, the material can be used without further heat treating, or the material can be used without any superplastic forming.

The following examples are intended to illustrate aspects of the invention, but should not be taken as limiting the invention in any respect.

EXAMPLE 1

The preferred procedure described previously was used to fabricate sheets of unreinforced PM-64 alloy and PM-64 composite containing 0.10 volume fraction of silicon carbide reinforcement. The following table compares the ambient temperature mechanical properties of these materials with PM-64 extruded powder and with conventional 7475 aluminum alloy. All of the materials presented in the table were given a peak aging treatment, including a solution treatment at 482° C. for ½ hour followed by a water quench to ambient temperature and a two-step aging treatment of 121° C. for 24 hours and 165° C. for 5 hours. The reported uniform elongation in percent, yield strength in thousands of pounds per square inch, and tensile strength in thousands of pounds per square inch are the averages of two tests in each case, and elongation was measured over a one inch gauge length. The modulus is the Young's modulus in millions of pounds per square inch.

| Material | Elong. | Yield | Tensile | Modulus |
|---|---|---|---|---|
| PM-64 sheet | 12.3 | 88.0 | 92.4 | 10.8 |
| PM-64/.10 SiC | 5.8 | 86.6 | 96.1 | 12.9 |
| PM-64 extrusion | 9 | 90.0 | 95.0 | — |
| 7475 aluminum | 11 | 73.0 | 83.0 | 10.4 |

The PM-64 sheet given the thermomechanical processing of the invention has mechanical properties close to those of the PM-64 extrusion, indicating that the thermomechanical processing does not adversely affect the properties. The PM-64 composite with 0.10 volume fraction silicon carbide reinforcement exhibits a 20 percent increase in modulus as compared with the PM-64 sheet of the invention, and an even greater modulus improvement as compared with conventional 7475 aluminum. Thus, the superplastically formable composite can be treated to have modulus and yield strength superior to those of conventional aluminum alloys. The elongation to failure at ambient temperature of the composite is below that of the unreinforced PM-64 sheet and the conventional 7475 material, but is still sufficient for many applications.

EXAMPLE 2

Samples were prepared of the unreinforced PM-64 alloy and the PM-64 alloy reinforced with 0. 10 volume fraction silicon carbide, using the process previously described. The samples were tested for the properties indicative of superplastic formability. At a testing temperature of 500° C. and a strain rate of $2\times10^{-4}$ per second, the unreinforced. PM-64 material exhibited superplastic uniform elongations of 700 to 900 percent, and at a strain rate of $10^{-3}$ per second uniform elongations of greater than 600 percent were attained. The alloy can thus be superplastically formed at relatively high rates, an important consideration in commercial operations. The "m" value, or slope of the log stress-log strain plot for the unreinforced alloy reaches about 0.8 in the range of $10^{-3}$ per second strain rate. The m value is a measure of the ability of the material to thin uniformly without the unstable deformation known as necking. Too low an m value results in a material which is unusable in superplastic forming applications.

At a testing temperature of 500° C. and in the range of strain rate of $2\times10^{-4}$ per second to $10^{-3}$ per second, the composite containing 0.10 volume fraction silicon carbide exhibited uniform elongations of over 450 percent, and an m value of 0.4–0.5. Although the composite does not have as good superplastic formability properties as the unreinforced alloy of the invention, its properties are sufficient for supeplastic fabrication of many commercial parts. The observed superplastic properties are surprising, in view of the presence of 0.10 volume fraction of the hard, nondeformable reinforcement which blocks grain boundary sliding.

EXAMPLE 3

Samples were prepared of the PM-64 alloy reinforced with 0.15 volume fraction and 0.20 volume fraction silicon carbide, using the process previously described. The ambient temperature modulus of the 0.15 volume fraction material was determined to be 14 million pounds per square inch. The superplastic forming uniform elongation at 516° C. and a strain rate of $2\times10^{4}$ per second was 300 percent for both materials. The m value for the 0.15 volume fraction material was sufficient for preparation of parts of uniform thickness, while the m value for the 0.20 volume fraction material was marginally low. From these results, it is projected that materials having greater volume fractions of reinforcement would have unacceptably low superplastic uniform elongation and m values.

EXAMPLE 4

Sheets of unreinforced PM-64 alloy and PM-64 alloy reinforced with 0.10 volume fraction silicon carbide were prepared by the preferred process of the invention, as described previously. A sheet of each panel was successfully formed by gas pressure into a female shaped die corresponding to the shape of an aircraft leading edge wing panel of dimensions of about 12 inches by 10 inches by ½ inch deep. The bottom of the die included irregular portions and recesses.

It will now be appreciated that the present invention represents an important advance in superplastically formable aluminum alloys and composite materials. The superplastically formable materials are prepared from powder starting materials, yet can be elongated several hundred percent during forming, without failure. The mechanical properties of the formed parts are excellent at ambient temperature, exceeding those of common alloys. Although a particular embodiment of the invention has been described in detail for purposes of illustration, various modifications may be made without departing from the spirit and scope of the invention. Accordingly, the invention is not to be limited except as by the appended claims.

What is claimed is:

1. A process for preparing a reinforced superplastically formable aluminum composite material, comprising the steps of:

furnishing an aluminum powder of a precipitation-hardenable aluminum alloy having a reduced oxygen and oxide content, the powder including coarse powder particles which are of a size that is retained on a 325 mesh standard powder sieve but passes through a 100 mesh standard powder sieve;

mixing with the aluminum powder a finely divided reinforcement in an amount less than about 0.20 volume fraction of the total mixture;

consolidating the mixture of aluminum powder and reinforcement to form a consolidated billet in a manner minimizing the incorporation of oxygen and oxides into the consolidated billet;

extruding the consolidated billet at an extrusion ratio of at least about 12 to 1 to break up the oxide coating on the aluminum powder particles; and thermomechanically processing the reduced billet to yield a microstructure of reinforcement distributed throughout a recrystallized aluminum alloy grain structure having coarse precipitates therein, said step of thermomechanically processing including the substeps of solution treating and quenching the extruded material.

overaging the solution treated and quenched material;

reducing the thickness of the overaged material by at least about 80 percent by warm rolling and warm cross rolling to form sheet material, and recrystallizing the sheet.

2. The process of claim 1, wherein the aluminum alloy consists essentially of about 7 weight percent zinc, 2.3 weight percent magnesium, 2 weight percent copper, 0.12 weight percent chromium. 0.2 weight percent cobalt, 0.23 weight percent zirconium, balance aluminum.

3. The process of claim 1, wherein the reinforcement is silicon carbide.

4. The process of claim 3, wherein the silicon carbide reinforcement passes through a 1000 mesh standard powder sieve.

5. The process of claim 1, wherein the extrusion ratio is at least about 18 to 1.

6. The process of claim 1, wherein the consolidated billet is contained within an evacuated container during said step of extruding.

7. The process of claim 1, wherein said step of reducing the thickness is accomplished by warm rolling the overaged material parallel to the extrusion direction to reduce its thickness by about 50 percent, and then warm cross rolling to a reduction of at least about 80 percent.

8. The process of claim 7, wherein the warm rolling temperature is about 300° C.

9. A composite material prepared by the process of claim 1.

10. A process for preparing a reinforced superplastically formable aluminum composite material, comprising the steps of:

mixing together a −100 to +325 mesh powder of a precipitation hardenable aluminum alloy, the powder particles having as low an oxygen and oxide content as possible, with up to about 0.20 volume fraction of finely divided silicon carbide reinforcement;

consolidating the mixture at elevated temperature and in a vacuum to form a consolidated billet;

extruding the consolidated billet at an extrusion ratio of at least about 12 to 1;

solution treating the extruded material above its solves temperature and quenching the solution treated material;

reducing the thickness of the solution treated and quenched material by at least about 80 percent to form sheet by warm rolling and warm cross rolling; and recrystallizing the rolled sheet.

11. The process of claim 10, wherein the aluminum alloy consists essentially of about 7 weight percent zinc, 2.3 weight percent magnesium, 2 weight percent copper, 0.1 weight percent chromium, 0.2 weight percent cobalt, 0.23 weight percent zirconium, balance aluminum.

12. A composite material prepared by the process of claim 10.

* * * * *